US005996244A

United States Patent [19]

Saarikivi et al.

[11] Patent Number: 5,996,244

[45] Date of Patent: Dec. 7, 1999

[54] ROLL FOR A PAPER MACHINE, IN PARTICULAR FOR A PAPER DRYING DEVICE, AND DRYER GROUP FOR A PAPER MACHINE

[75] Inventors: Pekka Saarikivi, Raisio; Raimo Virta, Turku, both of Finland

[73] Assignee: Valmet Corporation, Helsinki, Finland

[21] Appl. No.: 08/989,063

[22] Filed: Dec. 11, 1997

Related U.S. Application Data

[60] Provisional application No. 60/033,518, Dec. 18, 1996.

[30] Foreign Application Priority Data

Dec. 16, 1996 [FI] Finland ..... 965026

[51] Int. Cl.[6] ..... D21F 5/00; F26B 11/06

[52] U.S. Cl. ..... 34/115; 34/117; 34/120

[58] Field of Search ..... 34/115, 117, 120; 162/193, 370

[56] References Cited

U.S. PATENT DOCUMENTS

| | | | |
|---|---|---|---|
| 3,259,961 | 7/1966 | Bryand | 29/121 |
| 3,283,415 | 11/1966 | Schnyder | 34/111 |
| 3,550,286 | 12/1970 | Konttinen et al. | 34/162 |
| 3,773,614 | 11/1973 | Pennington | 162/357 |
| 4,202,113 | 5/1980 | Kankaanpaa | 34/23 |
| 4,441,263 | 4/1984 | Vedenpää | 34/115 |
| 4,516,330 | 5/1985 | Eskelinen et al. | 34/23 |
| 4,905,380 | 3/1990 | Eskelinen et al. | 34/23 |
| 5,022,163 | 6/1991 | Ilvespää et al. | 34/23 |
| 5,172,491 | 12/1992 | Ilvespää et al. | 34/115 |
| 5,347,728 | 9/1994 | Pinter et al. | 34/115 |
| 5,553,393 | 9/1996 | Korhonen et al. | 34/117 |

FOREIGN PATENT DOCUMENTS

| | | | |
|---|---|---|---|
| 46643 | 8/1969 | Finland | D21F 5/04 |
| 80491 | 3/1989 | Finland | D21F 5/04 |

*Primary Examiner*—Henry Bennett
*Assistant Examiner*—Steve Gravini
*Attorney, Agent, or Firm*—Steinberg & Raskin, P.C.

[57] ABSTRACT

A roll for a paper machine, in particular for a paper drying device, including an axle on whose support the roll revolves, and a surface construction connected to the axle by support members. The openness of the surface construction of the roll is higher than about 10%, preferably higher than about 20%, so that when the roll an effect is produced that sucks air inward into the roll whereby a flow of air through the roll arises. Also, a single-wire draw dryer group for a paper machine having two contact-drying cylinders and one reversing roll wherein a web to be dried is guided on support of a drying wire meandering from one drying cylinder onto the reversing roll and then onto the other drying cylinder so that on the drying cylinders, the web remains between the cylinder face and the drying wire and on the reversing cylinder, the web is situated at the side of the outside curve. The reversing roll in the dryer group is an open roll having a surface construction with an openness higher than about 10%, preferably higher than about 20%, so that the flow of air traveling along with the wire passes through the open surface construction of the roll into the interior of the roll and is discharged further out along with the wire as an air flow through the open surface construction of the roll.

22 Claims, 5 Drawing Sheets

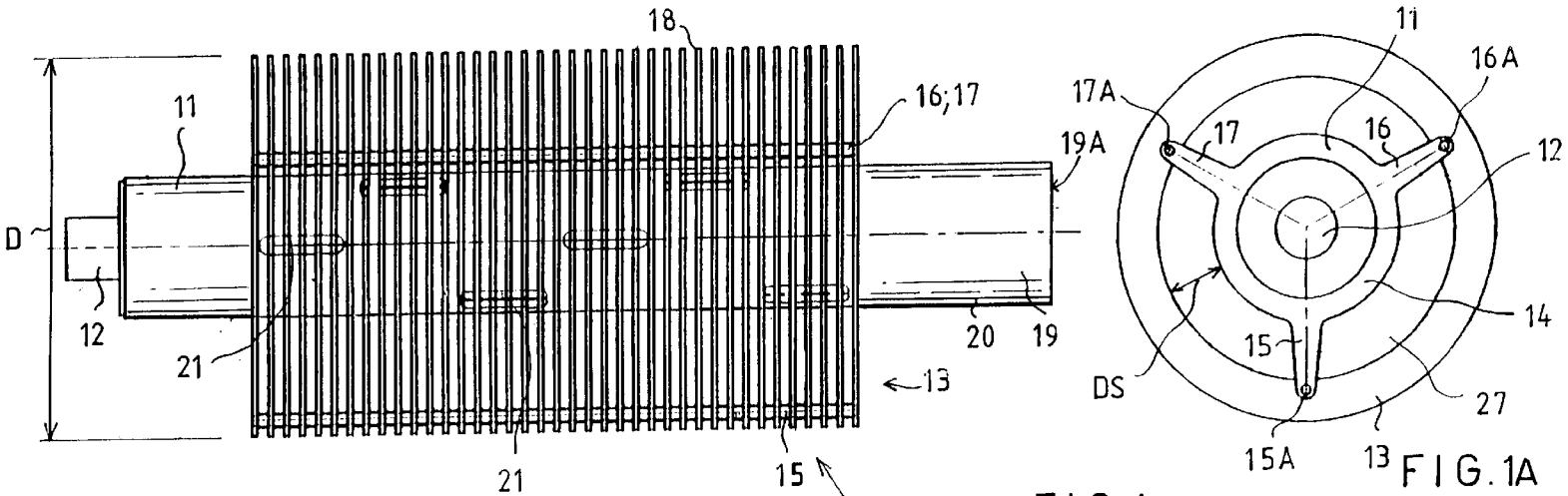
FIG. 1A
FIG. 1
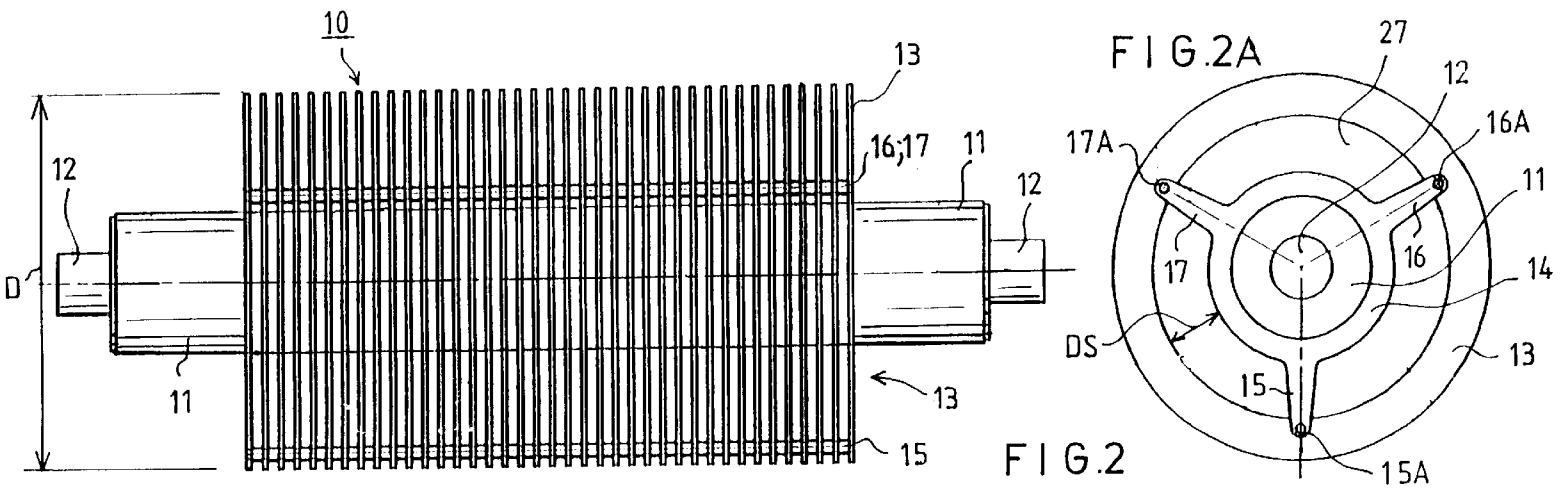
FIG. 2A
FIG. 2

ROLL FOR A PAPER MACHINE, IN PARTICULAR FOR A PAPER DRYING DEVICE, AND DRYER GROUP FOR A PAPER MACHINE

This application claims benefit of provisional application 60,033,518 filed Dec. 18, 1996.

FIELD OF THE INVENTION

The present invention relates to a roll for a paper machine, in particular for a paper drying device, which comprises an axle and a surface construction connected to the axle by support pieces. The roll is supported on the axle and revolves about the axle.

Further, the present invention relates to a dryer group for a paper machine comprising two contact-drying cylinders and at least one reversing roll and in which single-wire draw is applied. In the dryer group, the paper web to be dried is guided to run on support of a drying wire meandering from one of the contact-drying cylinders onto the reversing roll and further onto the other contact-drying cylinder, so that on the contact-drying cylinders, the paper web remains between the cylinder face and the drying wire and on the reversing cylinder the web is situated at the side of the outside curve.

BACKGROUND OF THE INVENTION

As known in the prior art, in multi-cylinder dryers of paper machines, twin-wire draw and/or single-wire draw is/are employed. When employing twin-wire draw, a group of drying cylinders comprises two closed (endless) wires, fabrics or belts which press the web, one from above and the other one from below, against heated cylinder faces of drying cylinders arranged in rows. Between the rows of drying cylinders, which are usually horizontal rows, the web has free and unsupported draws which are susceptible to fluttering and may cause web breaks, in particular in drying stages in which the web is still relatively moist and, therefore has a low strength. For this reason, in recent years, ever increasing use has been made of the single-wire draw in which each group of drying cylinders includes only a single closed (endless) drying wire on whose support the web runs through the entire group so that the drying wire presses the web on the drying cylinders against the heated cylinder faces thereof, whereas on the reversing cylinders or rolls between the drying cylinders, the web remains at the side of the outside curve and is subjected to negative pressure as it runs over the reversing cylinders in order to maintain the web on the wire. Thus, in single-wire draw, the drying cylinders are arranged outside the wire loop, and the reversing cylinders or rolls are arranged inside the wire loop.

In a so-called normal dryer group with single-wire draw, known in the prior art, the heated drying cylinders are placed in an upper row and the reversing cylinders or rolls are placed in a lower row below the upper row of drying cylinders, which rows are typically horizontal and parallel to one another. In a so-called inverted dryer group, the heated drying cylinders are placed in a lower row and the reversing cylinders or rolls are placed in an upper row above the lower row of drying cylinders. In the following, when the terms "normal (dryer) group" and "inverted (dryer) group" are used, what is meant is expressly groups with single-wire draw in multi-cylinder dryers, of the type mentioned above.

In prior art drying devices, the drying wire and the paper web come from a preceding drying element, for example a contact-drying suction cylinder, onto a reversing suction cylinder or equivalent as a joint straight run. In this case, a closing wedge space is formed between the drying wire and the face of the reversing suction cylinder, which wedge space is, in the following, also called an inlet nip. The moving drying wire and the face of the reversing suction cylinder tend to induce a pressure in the wedge space. This produces a difference in pressure acting upon the paper web placed on support of the drying wire, which difference in pressure attempts to separate the paper web from the drying wire and causes problems of runnability, wrinkles, and even web breaks. On the other hand, in order to improve the efficiency of dryer sections, there is a need to use ever more compact dryer sections in which the contact-drying cylinders and suction cylinders are placed as close to one another as possible. All of these factors, together with the increasing web speeds, increase the problems of the pressure induced in the inlet nip.

As known in the prior art, in single-wire draw, the transfer of the paper web from a reversing suction cylinder onto a contact-drying cylinder usually takes place so that the web is supported on the wire by means of a field of vacuum produced by a blow box or equivalent web-adhering arrangement. The current assignee markets blow boxes with the trade mark UNO-RUN-BLOW-BOX™, and with respect to the principle of operation of such blow boxes, reference is made to the current assignee's U.S. Pat. No. 4,516,330 (corresponding to Finnish Patent No. 65,460), incorporated by reference herein. By means of these blow box constructions, the paper web can be passed from a drying cylinder onto a reversing suction cylinder at the paper machine running speeds of less than about 1600 meters per minute currently in use.

In the prior art constructions, attempts have also been made to eliminate the problem related to the pressure peak induced in the inlet nip by means of suction in rolls, suction in sectors of rolls, and by means of suction boxes of different types as well as by means of combinations of rolls and suction boxes. However, by means of such arrangements, it has, however, not been possible to eliminate the pressure peak formed in the inlet nip.

In the prior art, it is known that, in order to hold the web in contact with the face of a reversing cylinder or roll, a vacuum is sufficient that overcomes the force arising from the centrifugal force. This required pressure can be calculated by means of the equation:

$$p = \frac{Pv \cdot U^2}{r}$$

wherein:

p=pressure (N/sq.m),

Pv=basis weight of web (kg/sq.m),

U=circumferential speed (meters per second), r=radius of cylinder (meters).

Depending on the running speed of the machine and the weight of the web, the requirement of pressure is of an order of from about 100 Pa to about 200 Pa. Thus, a problem has been the control of the pressure formed in the inlet nip.

It has also been possible to reduce the detrimental pressure induced in the inlet nip by means of grooves and bores on the roll. However, by means of these structural modifications, it has not been possible to provide a substantial solution for the problems arising from the pressure induced in the inlet nip.

With respect to the prior art related to the present invention, reference is made to U.S. Pat. No. 3,259,961 which describes a cell construction that produces a pressure in the inlet nip because it comprises walls arranged perpendicular to the movement of rotation.

Further, reference is made, for example, to the current assignee's U.S. Pat. Nos. 4,202,113 and 4,441,263 (both of which are incorporated by reference herein) and Finnish Patent Nos. 93,876 (corresponding to U.S. Pat. No. 5,553, 393, incorporated by reference herein) and 83,680 (corresponding to U.S. Pat. Nos. 5,022,163 and 5,172,491, incorporated by reference herein), which describe devices in dryer section of paper machine but which, do not suggest a fully adequate solution for the problems arising from the pressure formed in the inlet nip.

OBJECTS AND SUMMARY OF THE INVENTION

It is an object of the present invention to further develop the prior art described above and equivalent technology so that the problems caused by the narrow wedge-shaped inlet nip area in the draw of the web can be largely solved.

Another important object of the invention is to improve the runnability in single-wire draw dryer groups so that the formation of detrimental pressure in the inlet nip is compensated for or avoided.

It is another object of the present invention to provide a new and improved roll about which the inlet nip is formed which compensates for or eliminates the pressure formed in the inlet nip.

It is a further object of the invention to permit a more compact dryer group in a paper machine.

In view of achieving the objects stated above and others, the roll in accordance with the invention for a paper machine, and in particular for a paper drying device, has a surface construction having an openness higher than about 10%, preferably higher than about 20%, so that when the roll revolves, an effect is produced that sucks air inward into the roll, whereby a flow of air through the roll arises.

The dryer group in accordance with the invention includes at least one reversing rolls which is an open roll having a surface construction with an openness higher than about 10%, preferably higher than about 20%, so that the flow of air traveling along with the wire passes through the open surface construction of the roll into the interior of the roll and is discharged further out along with the wire as an air flow through the open surface construction of the roll.

The construction of the roll in accordance with the invention is open, preferably open as slot-shaped, which prevents formation of pressure in the inlet nip. Both the surface construction and the interior construction of the roll are formed substantially open so that the flow of air carried along with the wire enters into the roll interior and revolves there at a speed slower than the speed of rotation of the roll and departs from the roll interior as an air flow from the outlet nip along with the wire. As the roll revolves, the roll construction produces an intensive inflow of air, in which connection, the roll operates similarly to a flow-through blower.

The flow into the roll interior takes place mainly by the effect of the outflow of air produced by centrifugal force in the area of the opening nip. A pocket space, which is opened in a suitable way for the air present in the gaps in the open, in particular slot-like surface construction, produces a blow effect outwards, as a result of which, air flows correspondingly into the roll interior from the area of the closing nip. In the roll interior, air flows at a velocity slower than the speed of rotation of the roll, because formation of centrifugal force is prevented by the effect of the inside openness of the roll, in which case, the air present in the roll interior does not revolve at the same speed as the roll.

According to a preferred exemplifying embodiment of the invention, the open construction of the roll is obtained by means of a plate-like surface construction and by means of a shape open in the interior, in which the openness of the surface construction is higher than about 10%, preferably higher than about 20%.

According to the invention, the roll is used preferably in an area of single-wire draw in a paper machine. The diameter of the roll in accordance with the invention is preferably substantially smaller than the diameters of several prior art reversing roll and cylinder embodiments, in which case the roll can be placed closer to the contact-drying cylinders (more proximate than in prior art constructions) and moreover, it permits a compact arrangement of the dryer group, whereby a very compact dryer section is achieved. The roll in accordance with the invention is also suitable for use as a paper guide roll if the formation of an air layer between the roll face and the paper constitutes a problem.

According to the invention, in order to prevent formation of pressure in the area of the pocket space, a blow box or equivalent device can also be provided in connection with the roll so as to prevent entrance of air into the pocket space. This can be accomplished by means of a box operating by means of the blow principle or by means of inhibition sealing, for example by means of a passive box by means of whose shape, the free face of the roll is divided into two parts, i.e., into an out-blowing part and an in-flowing part.

More particularly, the roll for a paper machine, in particular for a paper drying device, in accordance with the invention comprises a rotatable axle, surface forming means for forming an outer substantially cylindrical surface at a distance from the axle to thereby define an open space between the surface and the axle, and support means for supporting the surface forming means on the axle. The surface forming means generally define openings extending from the surface to the space between the surface and the axle and such that at least about 10% of the surface is open. The openings are arranged such that upon rotation of the roll, medium such as air is drawn through the openings in the surface into the space between the surface and the axle and flows through the roll. The surface forming means may be structured and arranged such that a velocity of the medium flowing through the space between the surface and the axle upon rotation of the roll is different than a speed of rotation of the roll. The surface forming means further define an inner substantially cylindrical surface whereby the openings extend from the outer substantially cylindrical surface to the inner substantially cylindrical surface and the space is defined between the inner substantially cylindrical surface and the axle and is annular. A ratio of a length portion along the diameter of the roll in the annular space to the diameter of the roll is preferably from about 1:10 to about 1:1.5.

In one specific embodiment, the surface forming means comprise annular plates arranged around the axle and at a distance from one another in an axial direction of the roll such that the openings are defined between the annular plates. The support means thus comprise support pieces arranged in connection with the axle and extending outward from the axle, and support bars connected to the support pieces and the annular plates. The annular plates may each comprise an annular disk having a substantially cylindrical outer circumferential surface, an inner circumferential surface and openings extending inward from the inner circumferential surface.

In the alternative, the surface forming means comprise elongate bars extending in an axial direction of the roll and arranged in a circle such that an outer peripheral surface of the bars combine to provide the substantially cylindrical surface, and support rings for interconnecting the bars. The support means comprise end flanges connected to the axle and the bars in this embodiment.

The invention will be described in detail with reference to some preferred embodiments of the invention illustrated in the figures in the accompanying drawing. However, the invention is not confined to the illustrated embodiments alone.

BRIEF DESCRIPTION OF THE DRAWINGS

Additional objects of the invention will be apparent from the following description of the preferred embodiment thereof taken in conjunction with the accompanying non-limiting drawings, in which:

FIG. 1 is a schematic illustration of an exemplifying embodiment of a roll in accordance with the invention provided with suction;

FIG. 1A is a view of the roll shown in FIG. 1 taken in the direction of arrow A;

FIG. 2 is a schematic illustration of a further exemplifying embodiment of a roll in accordance with the invention;

FIG. 2A is a view of the roll shown in FIG. 2 taken in the direction of arrow A;

DETAILED DESCRIPTION OF THE PREFERRED EMBODIMENTS

Figure 3A:
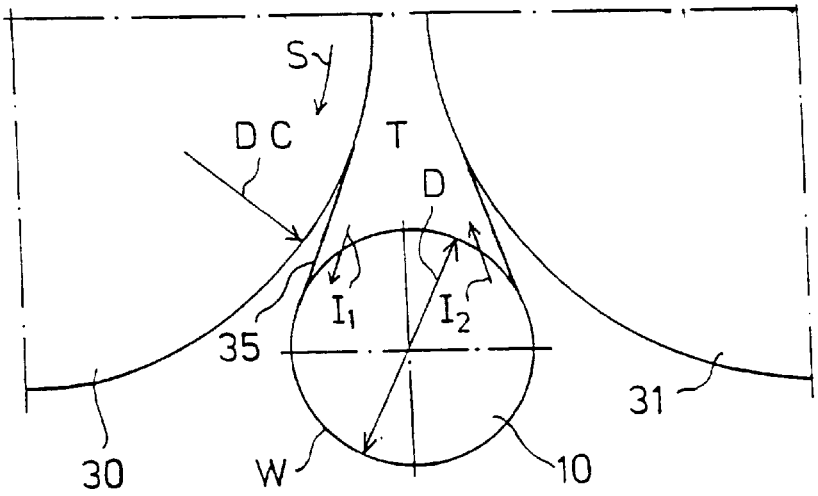
FIG. 3A illustrates an application of operation of a roll in accordance with the invention.

Referring to FIGS. 1–8 wherein like reference numerals refer to the same or similar elements, as shown in FIGS. 1 and 1A, a roll in accordance with the invention is designated generally as 10 and comprises an axle 11 and one or more axle journals 12 arranged at a respective end thereof. In the exemplifying embodiment of the invention shown in FIG. 1, the roll 10 is provided with suction, and elongate suction openings 21 are formed into the axle 11 of the roll 10. The roll axle 11 is hollow and includes a mantle 20 defining a suction space 19 in the interior of the axle 11, the suction openings 21 being forming in the mantle 20. Suction space 19 of the axle 11 communicates through an end 19A of the mantle 20 with a vacuum source (i.e., a source of negative pressure—not shown). According to the invention, the surface construction of the roll is formed to provide a substantially cylindrical surface which is partially open. These surface forming means comprise a mantle part 13 of the roll made of plate-like circular annular plates 18 arranged at a distance from one another such that circular openings are formed between adjacent annular plates 18. Annular plates 19 are open in the middle and are supported by one or more support pieces 14 (FIG. 1A). The annular plates are interconnected by appropriate connecting members such as fastening bars 15A, 16A, 17A which pass through the ends of arms 15,16,17 arranged on the support piece 14. Thus, the roll construction 10 is very open since a space remains between each annular plate 18. In a similar manner, an open area 27 remains between the outer circumference of the support pieces 14 and the inner circumference of the annular plates 18 (FIG. 1A). The support pieces 14, by whose means the annular plates 18 are interconnected, are fixed to or part of the axle 11. The volume of the open area 27 is from about 20% to about 80%, preferably from about 40% to about 70%, of the volume of the roll 10.

The support pieces 14 are arranged at each end of the axle 11 and appropriately spaced along the length of the roll so that the support bars 15A, 16A, 17A attached to the arm parts 15,16,17 of the support pieces 14 extend through all the annular pieces 18, whereby the annular pieces 18 form a roll 10 which has an open surface construction and an open inner construction. The roll is provided with the axle 11 mainly because of its need for fastening and support for the support pieces 14 and strength.

The exemplifying embodiment shown in FIG. 2 is similar to that shown in FIG. 1, and the same reference numerals refer to corresponding parts. In this exemplifying embodiment of the invention the roll 10 is, however, not provided with suction, in which case the axle 11 is solid. FIG. 2 also shows the axle journals 12 at each end of the axle 11.

The diameter D of the roll 10 is from about 500 mm to about 1500 mm, preferably from about 600 mm to about 1000 mm, and the proportion of the open interior area DS (the open length portion along the diameter of the roll between the inner circumference of the annular plates 18 and the outer circumference of the support pieces 14) is from about 20% to about 80%, preferably from about 40% to about 70%, of the diameter D of the roll. The openness of the surface construction of the roll 10, i.e., the amount of the substantially cylindrical surface of the roll which is open and allows passage from an exterior of the roll to the interior of the roll, is higher than about 10%, preferably higher than about 20%.

FIG. 3A shows a roll in accordance with the invention in an application of operation 20 in accordance with the invention as a reversing roll in a dryer group with single-wire draw. A paper web W to be dried comes from a drying cylinder 30, whose direction of rotation is indicated by arrow S, on support of a drying wire 35 onto the reversing roll 10, and the web is placed at the side of the outside curve and the wire 35 is placed against the reversing roll 10. From the reversing roll 10, the wire 35 and the paper web to be dried are passed onto the next drying cylinder 31. The space T that remains between the cylinders 30,31 and the reversing roll 10 and the wire 35 is called a pocket space. The reversing roll 10 in accordance with the invention has the effect that the air flow $I_1$ that travels along with the wire 35 is drawn or sucked intensively into the interior of the roll 10, flows through the interior of the roll 10 and is discharged from the other side of the roll 10 as an air flow $I_2$ out of the roll and then flows out of the pocket space T along with the wire 35.

Figure 3B:
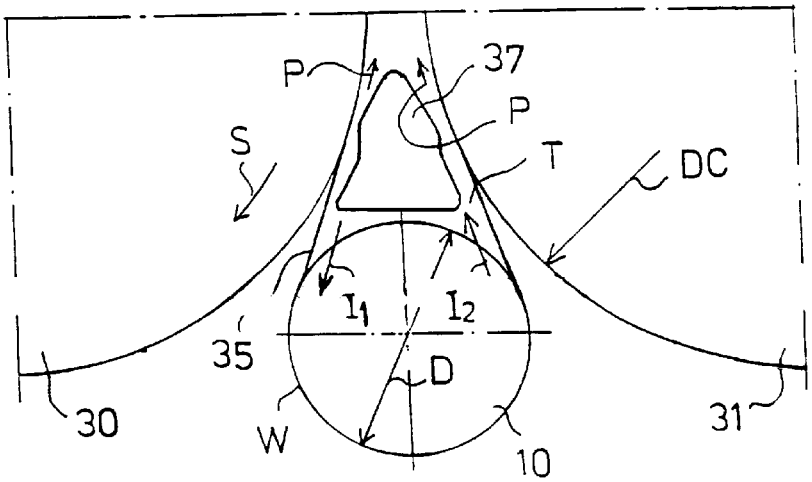
FIG. 3B illustrates a second application of operation of a roll in accordance with the invention in which, in connection with the roll, a blow box is arranged in the pocket space.

FIG. 3B shows an exemplifying embodiment of the invention similar to FIG. 3A, wherein a blow box 37 is arranged in the pocket space T, the blowings from the blow box being denoted by reference P. By means of this arrangement, substantially the entire pocket space T is subjected to a vacuum, i.e., the pressure in the pocket space T is reduced by the blowings which cause air to be removed from the pocket space T.

Figure 3C:
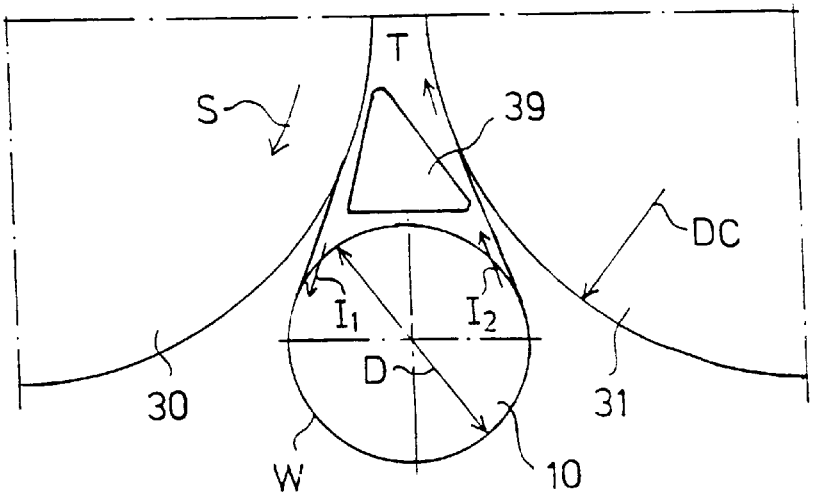
FIG. 3C shows a further application of operation of a roll in accordance with the invention in which a passive box is arranged in connection with the roll in the pocket space.

FIG. 3C shows an exemplifying embodiment of the invention similar to FIG. 3A, wherein, in order to make the air flows in the pocket space T more accurate and to subject the pocket space T to a vacuum, a passive box 39 is provided (one which does not eject air blowings), by whose means the free face of the roll 10 is divided into two parts, i.e., an in-flowing part and an out-blowing part.

Figure 4A:
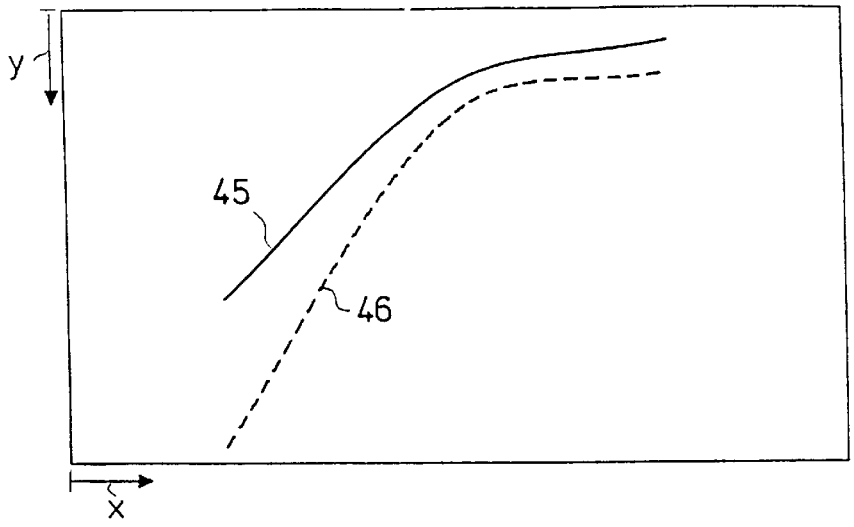
FIG. 4A is a schematic illustration of measurement results related to an arrangement in accordance with the invention and illustrating the vacuum on the wire face without a blow box.

FIG. 4A is a schematic illustration of test results in a test with an arrangement in accordance with the invention in an installation as shown in FIG. 3A. The Y axis represents the vacuum, and the X axis represents the distance from the closing or inlet nip. Curves 45 and 46 illustrate the vacuum on the wire face. The curve 45 indicated as a solid line illustrates a test result in which the speed of the web was about 1500 meters per minute, and the dashed line 46 illustrates a test result in which the speed of the web was about 1800 meters per minute. As seen from curves 45,46, the vacuum becomes higher when the web running speed becomes higher. Further, the vacuum is higher near the closing nip, which indicates that the flow takes place into the roll from the nip.

Figure 4B:
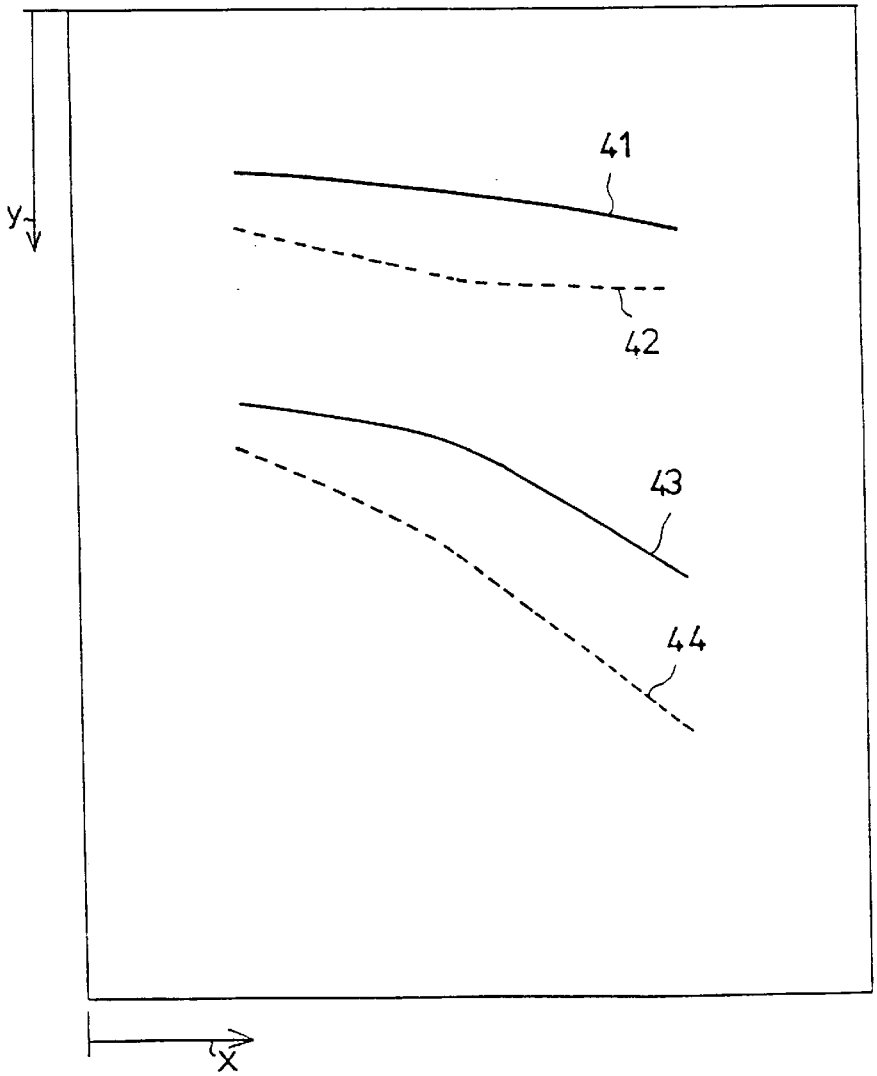
FIG. 4B is a schematic illustration of measurement results related to an arrangement in accordance with the invention and illustrating the vacuum on the inlet face of the wire underneath a blow box.

FIG. 4B is a schematic illustration of test results in a test with an arrangement in accordance with the invention in an installation as shown in FIG. 3B. As in FIG. 4A, the Y axis represents the vacuum, and the X axis represents the distance from the closing nip. Curves 41,42,43,44 illustrate the vacuum on the inlet face of the wire underneath the blow box. The curves 41,43 drawn as a solid line illustrate a test result in which the speed of the web was about 1500 meters per minute, and the dashed line 42,44 illustrate a test result in which the speed of the web was about 1800 meters per minute. The curves 41 and 42 illustrate a situation in which the blowing of the blow box had not been switched on, i.e., the blow box was present but not operating, and the curves 43 and 44 illustrate a situation in which the blowing of the blow box had been switched on, i.e., the blow box was present and operating. FIG. 4B shows that the vacuum in the pocket space becomes higher with a higher speed, which is contrary to normal-roll and suction-roll solutions.

Figure 5A:
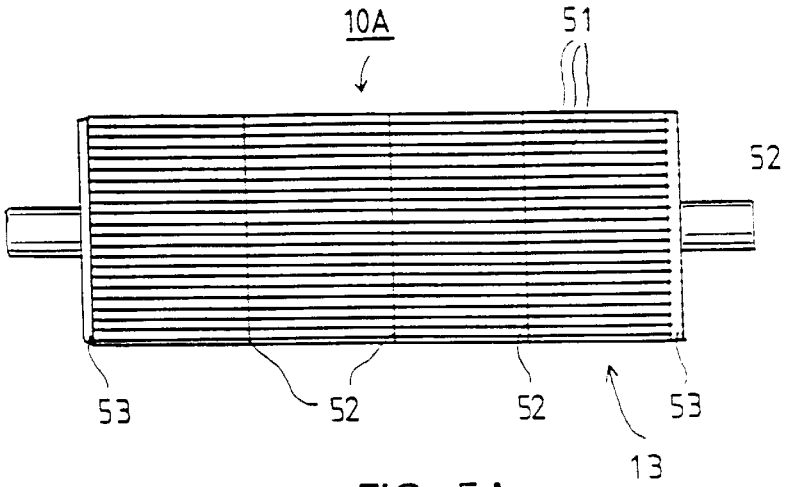
FIGS. 5A and 5B illustrate an embodiment of a roll in accordance with the invention.
Figure 5B:
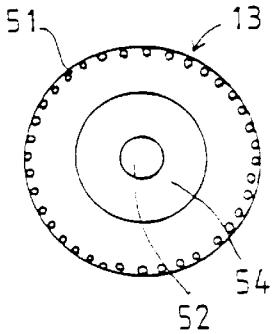

FIGS. 5A and 5B show an exemplifying embodiment of the invention in which a roll 10A with an open construction is composed of longitudinal bars or a net 51, which are interconnected by intermediate rings 52 and end flanges or rings 53 to obtain an open surface construction and an intermediate space that remains between an axle 50 and a surface construction of a support roll 54. The longitudinal bars 51 extend in an axial direction of the roll 10A and are arranged in a circle such that an outer peripheral surface of the bars 51 combine to provide a substantially cylindrical surface. The end flanges 53 connect the bars 51 to the axle 50. In this embodiment, the openings in the surface of the roll 10A are elongate and oriented in an axial direction of the roll 10A. The bars 51 may have a circular cross-section as shown in FIG. 5B.

Figure 6A:
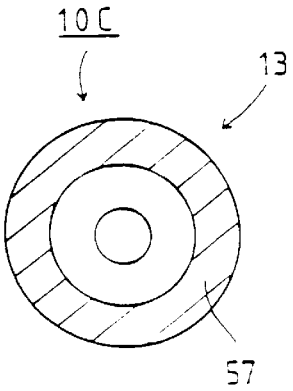
FIGS. 6A, 6B and 6C illustrate further possibilities for a roll of the invention.
Figure 6B:
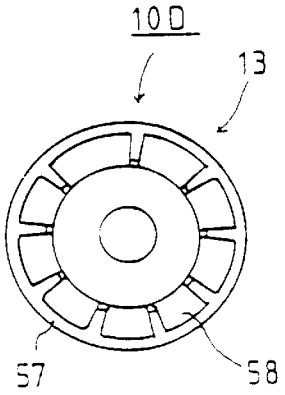
Figure 6C:
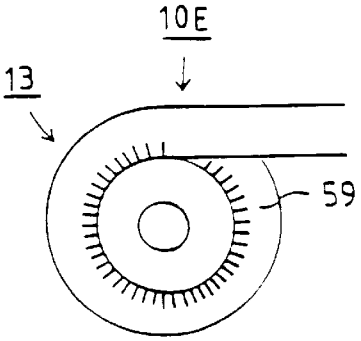
Figure 7:
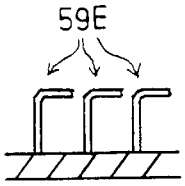
FIG. 7 is a schematic illustration of an arrangement for use in connection with a roll in accordance with the invention.

FIGS. 6A, 6B and 6C are schematic end views of different rolls in accordance with the invention. The roll 10A shown in FIG. 6A is composed of separate annular disks 57. The roll 10B shown in FIG. 6B is composed of disks 57 lightened by means of openings 58 extending inward from an inner circumferential surface. The outer circumferential surface of the disks 57 combine to provide the roll 10B with a substantially cylindrical surface. These disk constructions 57 can be used as the annular plates 18 in the rolls shown in FIGS. 1 and 2. The roll 10E shown in FIG. 6C is formed out of a sheet 59 shaped in accordance with the ribbed-pipe principle, i.e., spirally wound (the stage of winding being shown) and, as shown in FIG. 7, it can be provided with folds 59E. Thus, the sheet 59 is appropriately folded to form the circular roll 10E. In the embodiments shown in FIGS. 5A–6C, the diameter of the rolls 10A–10E is from about 500 mm to about 1500 mm, preferably from about 600 mm to about 1000 mm, and the openness, i.e., the percentage of the cylindrical surface defined by the roll which is apertured, is higher than about 10%, preferably higher than about 20%.

Figure 8:
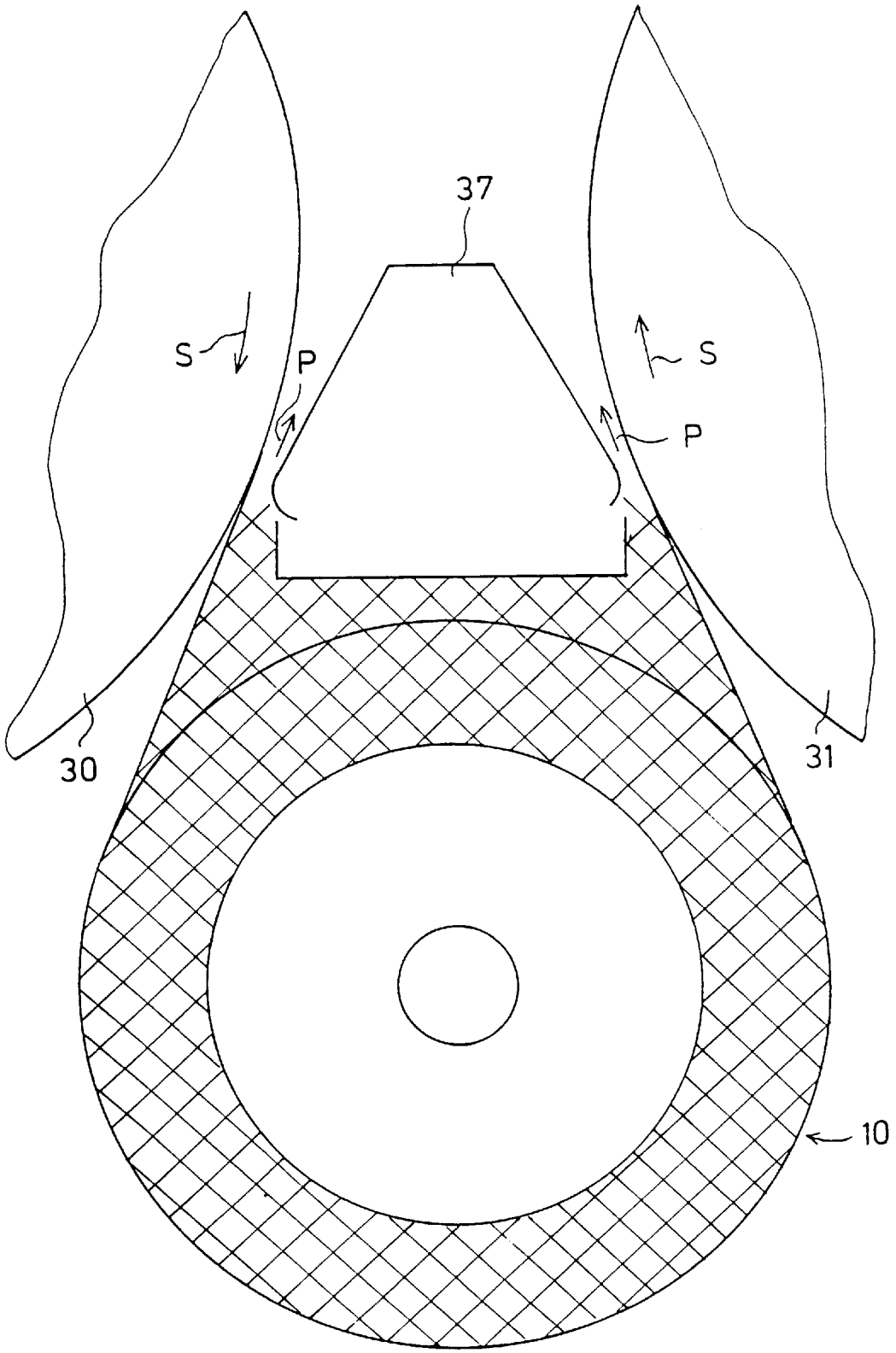
FIG. 8 is a schematic illustration of an exemplifying embodiment of a roll in accordance with the invention in an application of operation of same.

FIG. 8 shows an arrangement corresponding to the exemplifying embodiment shown in FIG. 3B in single-wire draw in a dryer section, and the checkered area indicates the area of vacuum produced in connection with the roll 10 and the pocket space T by the effect of the roll 10 and the blow box 37. As shown in FIG. 8, there is the same pressure because of the open construction underneath the blow box 37 and inside the roll 10.

Above, some preferred embodiments of the invention have been described, and it is obvious to a person skilled in the art that numerous modifications can be made to these embodiments within the scope of the inventive idea defined in the accompanying patent claims. As such, the examples provided above are not meant to be exclusive. Many other variations of the present invention would be obvious to those skilled in the art, and are contemplated to be within the scope of the appended claims.

We claim:

1. A roll for a paper machine, in particular for a paper drying device, comprising a rotatable axle, surface forming means for forming an outer substantially cylindrical surface at a distance from said axle to thereby define an open space between said surface and said axle, said surface forming means further defining openings extending from said surface to said space between said surface and said axle and such that at least 10% of said surface is open, and support means for supporting said surface forming means on said axle such that said surface forming means rotate together with said axle, said openings being arranged such that upon rotation of said axle, medium is drawn through said openings in said surface into said space between said surface and said axle and flows through the roll.

2. The roll of claim 1, wherein said openings encompass at least 20% of said surface.

3. The roll of claim 1, wherein said surface forming means are structured and arranged such that a velocity of the medium flowing through said space between said surface and said axle upon rotation of the roll is different than a speed of rotation of the roll.

4. The roll of claim 1, wherein said surface forming means further define an inner substantially cylindrical surface, said openings extending from said outer substantially cylindrical surface to said inner substantially cylindrical surface, said space being extending from said inner substantially cylindrical surface to said axle and being annular.

5. The roll of claim 4, wherein a ratio of a length portion along the diameter of the roll in said annular space to the diameter of the roll is from 1:10 to 1:1.5.

6. The roll of claim 1, wherein said surface forming means comprise annular plates arranged around said axle and at a distance from one another in an axial direction of the roll such that said openings are defined between said annular plates, said support means comprising support pieces arranged in connection with said axle and extending outward from said axle, and support bars connected to said support pieces and said annular plates.

7. The roll of claim 6, wherein said annular plates each comprise an annular disk having a substantially cylindrical outer circumferential surface, an inner circumferential surface and openings extending inward from said inner circumferential surface.

8. The roll of claim 1, wherein said surface forming means comprise elongate bars extending in an axial direction of the roll and arranged in a circle such that an outer peripheral surface of said bars combine to provide said substantially cylindrical surface, and support rings for interconnecting said bars, said support means comprising end flanges connected to said axle and said bars.

9. The roll of claim 1, wherein said surface forming means comprise a sheet band folded to form a circular roll.

10. The roll of claim 1, wherein the diameter of the roll is from 500 mm to 1500 mm.

11. The roll of claim 1, wherein the diameter of the roll is from 600 mm to 1000 mm.

12. The roll of claim 1, wherein said axle comprises a mantle defining an interior suction space and having suction openings extending from said interior space through said mantle, said interior space of said mantle being adapted to be connected to a vacuum source such that the medium flowing through said space between said surface and said axle flows into said interior suction space of said mantle.

13. The roll of claim 1, wherein said openings in said surface are circular.

14. The roll of claim 1, wherein said openings are elongate and oriented in an axial direction of the roll.

15. In a single-wire dryer group for a paper machine including two drying cylinders, one reversing roll and a drying wire for supporting a paper web in a run from a first one of the drying cylinders onto the reversing roll and then onto a second one of the drying cylinders such that the web is situated between a face of each drying cylinder and the drying wire in its run about the drying cylinders and at a side of an outside curve in its run about the reversing roll, the improvement comprising:

the reversing roll comprising a rotatable axle, surface forming means for forming an outer substantially cylindrical surface at a distance from said axle to thereby define an open space between said surface and said axle, said surface forming means further defining openings extending from said surface to said space between said surface and said axle and such that at least 10% of said surface is open, and support means for supporting said surface forming means on said axle such that said surface forming means rotate together with said axle, said openings being arranged such that upon rotation of said axle, medium is drawn through said openings in said surface into said space between said surface and said axle, flows through said space, and is discharged from said space to travel along with the drying wire after its separation from the reversing roll.

16. The dryer group of claim 15, wherein the drying cylinders are arranged adjacent one another and the reversing roll is arranged below the drying cylinders such that a pocket space is defined between the drying cylinders and the reversing roll, further comprising a blow box arranged in said pocket space to direct blowings to cause air to be removed from said pocket space thereby lowering the pressure in said pocket space.

17. The dryer group of claim 15, wherein the drying cylinders are arranged adjacent one another and the reversing roll is arranged below the drying cylinders such that a pocket space is defined between the drying cylinders and the reversing roll, further comprising a passive box arranged in said pocket space for partitioning a free, uncovered face of the reversing roll into an in-flow area and an out-flow area.

18. The dryer group of claim 15, wherein a ratio of the diameter of each of the drying cylinders to a diameter of the reversing roll is from 1:1 to 4:1.

19. The dryer group of claim 15, wherein said surface forming means comprise annular plates arranged around said axle and at a distance from one another in an axial direction of the roll such that said openings are defined between said annular plates, said support means comprising support pieces arranged in connection with said axle and extending outward from said axle, and support bars connected to said support pieces and said annular plates.

20. The dryer group of claim 15, wherein said surface forming means comprise elongate bars extending in an axial direction of the roll and arranged in a circle such that an outer peripheral surface of said bars combine to provide said substantially cylindrical surface, and support rings for interconnecting said bars, said support means comprising end flanges connected to said axle and said bars.

21. The roll of claim 1, wherein said support means are arranged to connect said surface forming means to said axle.

22. The dryer group of claim 15, wherein said support means are arranged to connect said surface forming means to said axle.

* * * * *